US006739563B1

(12) United States Patent
Wallace

(10) Patent No.: US 6,739,563 B1
(45) Date of Patent: May 25, 2004

(54) TUBULAR BUMPER MOUNT AND APPARATUS

(75) Inventor: James Wallace, Lynnfield, MA (US)

(73) Assignee: Boston Metal Products, Inc., Medford, MA (US)

( * ) Notice: Subject to any disclaimer, the term of this patent is extended or adjusted under 35 U.S.C. 154(b) by 0 days.

(21) Appl. No.: 10/460,272

(22) Filed: Jun. 12, 2003

Related U.S. Application Data

(60) Provisional application No. 60/467,429, filed on May 2, 2003.

(51) Int. Cl.[7] ..... A47B 95/00
(52) U.S. Cl. ..... 248/345.1; 248/694
(58) Field of Search ..... 248/694, 345.1, 248/530, 511, 686, 688, 548, 539; 293/133

(56) References Cited

U.S. PATENT DOCUMENTS 5,369,925 A * 12/1994 Vargo ..... 52/244
6,044,601 A * 4/2000 Chmela et al. ..... 52/287.1

* cited by examiner

*Primary Examiner*—Ramon O Ramirez

(74) *Attorney, Agent, or Firm*—Kudirka & Jobse, LLP

(57) ABSTRACT

Apparatus for mounting an elongated tube, the elongated tube extending from a receiving end to an opposing distal end, the receiving end comprising an open aperture and a hollow tubular receiving portion having a longitudinal axis and an inner wall surface radially disposed relative to the longitudinal axis, the apparatus comprising:

a mount having an axis, the mount comprising one or more radially extending members having circumferential surfaces or projections for mating with the inner wall surface of the hollow tubular receiving portion of the elongated tube under friction or pressure, the mount being receivable within the hollow tubular portion of the elongated tube wherein the one or more circumferential surfaces are friction fittable against the inner wall surface of the hollow tubular receiving portion of the elongated tube such that the axis of the mount is substantially aligned with or parallel to the axis of the hollow tubular receiving portion of the elongated tube;

the mount including one or more legs each leg having a longitudinal axis, the one or more legs being rigidly interconnected to the radially extending members wherein the longitudinal axis of the hollow tubular receiving portion of the elongated tube is substantially aligned with or substantially parallel to the axes of the one or more legs.

21 Claims, 4 Drawing Sheets

TUBULAR BUMPER MOUNT AND APPARATUS

RELATED APPLICATIONS

This application claims the benefit of priority under 35 USC Section 119 to U.S. provisional patent application serial No. 60/467,429 filed May 2, 2003, the disclosure of which is incorporated herein by reference in its entirety as if fully set forth herein.

FIELD OF THE INVENTION

The present invention relates to protection of furniture, fixtures, cabinets, shelves, display shelving, outdoor entranceways, parking lot areas, sidewalks, pedestrian walkways and the like from impact with shopping carts, carriages, cleaning appliances, transport carts, dolleys, vehicles and the like which are rolled or driven around on a walking or driving surface that located in, around or outside retail store, office building and other relatively heavily trafficked environments.

BACKGROUND OF THE INVENTION

Retail stores, parking lots, office and residential are often heavily trafficked areas where people move about on a floor or pavement surface pushing a cart or appliance or driving a vehicle. Display cases, shelves, counters and furniture installed within a retail store environment such as a food market or entranceways and sidewalks disposed around heavily trafficked buildings are prone to being unintentionally hit or otherwise invaded by a cart, cleaning appliance or moving vehicle that is being pushed or driven by a person occupying or moving around in such areas. Upright bumpers can be installed at selected locations adjacent or near the displays, shelves, furniture et al. for reducing the occurrence of impact. Conventional upright bumpers typically comprise rails or posts affixed to a mounting plate that is secured to the ground for mounting the bumper.

SUMMARY OF THE INVENTION

In accordance with the invention there is provided an apparatus for mounting an upright elongated tube, the elongated tube extending from a receiving end to an opposing distal end, the receiving end comprising an open aperture and a hollow tubular receiving portion having an axis and an inner wall surface radially disposed relative to the axis, the apparatus comprising:

- a mounting disc having an axis and one or more circumferential surfaces or projections for mating with the inner wall surface of the hollow tubular receiving portion of the elongated tube under friction or pressure,
- the disc being mounted within the hollow tubular portion with the one or more circumferential surfaces mated with the inner wall surface such that the axis of the disc is substantially aligned with or parallel to the axis of the hollow tubular receiving portion of the elongated tube; and,
- one or more mounting struts each having a longitudinal axis, the one or more struts being rigidly interconnected to the disc wherein the longitudinal axis of the hollow tubular receiving portion of the elongated tube is substantially aligned with or parallel to the axes of the one or more struts and the struts extend beyond the open end when the disc is mounted within the hollow tubular portion.

The disc typically comprises a plurality of discs rigidly interconnected to each other, the discs being arranged in parallel series to each other, each disc having an axis and being substantially coaxial.

The circumferential projections of each disc comprise one or more flanges extending radially outwardly from one or more selected locations around the circumference of one or more of the discs, the flanges being bendable under pressure to mate with the inner surface of the hollow tubular portion.

The one or more struts each have an outer circumferential surface that is receivable within one or more complementary apertures disposed within a ground surface for mounting the elongated tube in an upright orientation.

Preferably the elongated tube has an axial tube length wherein the disc (or multiple discs) is mounted within the hollow tubular portion extending from the open end along an axial length of the hollow tubular portion that is less than about one third of the axial tube length.

In another aspect of the invention there is provided an upright tubular bumper comprising:

- an elongated tube extending from a receiving end to an opposing distal end, the receiving end comprising an open aperture and a hollow tubular receiving portion having an axis and an inner wall surface radially disposed relative to the axis,
- a disc having an axis and one or more corresponding circumferential surfaces or projections for mating with the inner wall surface of the hollow tubular receiving portion of the elongated tube under friction or pressure,
- the disc being mounted within the hollow tubular portion with the one or more circumferential surfaces mated with the inner wall surface such that the axis of the disc is substantially aligned with or parallel to the axis of the hollow tubular receiving portion of the elongated tube; and,
- one or more mounting struts each having a longitudinal axis, the one or more struts being rigidly interconnected to the disc wherein the longitudinal axis of the hollow tubular receiving portion of the elongated tube is substantially aligned with or parallel to the axes of the one or more struts and the struts extend beyond the open end when the disc is mounted within the hollow tubular portion.

The tube that receives the mount is preferably comprised of a high impact resistant plastic or polymeric material.

The hollow tubular portion of the tube typically has an inner circumference having a diameter which is less than the diameter or maximum radially extending length of the disc or plurality of discs that are inserted within the hollow tubular portion of the tube to be mounted. Thus the mounting disc or plurality of discs are force fitted within the hollow tubular portion of the tube such that, once inserted, the mounting disc or assembly of discs is rigidly mounted within the tube under pressure. The mounting disc or plurality of discs and their associated circumferential surfaces or projections are typically comprised of a rigid but bendable metal material such as light gauge sheet metal.

In one embodiment, the mounting mechanism comprises two or more discs of sheet metal material having slots extending from select locations around the outer circumference of the discs in a radial direction toward the center of the discs. One leg of a bent or flanged strip of sheet metal can be disposed within the radially extending slots of the discs. The other leg of the flanged strip is bent at angle in relation to the one leg of the strip, and the radial slots are arranged such that the other leg of the metal strips project radially outward from the center of the disc a distance that is slightly greater than the inner diameter of the hollow tubular portion of the tube to be mounted.

In another aspect of the invention there is provided an apparatus for mounting an elongated tube, the elongated tube extending from a receiving end to an opposing distal end, the receiving end comprising an open aperture and a hollow tubular receiving portion having a longitudinal axis and an inner wall surface radially disposed relative to the longitudinal axis, the apparatus comprising:

a mount having an axis comprising one or more radially extending members having circumferential surfaces or projections for mating with the inner wall surface of the hollow tubular receiving portion of the elongated tube under friction or pressure, the mount being received within the hollow tubular portion of the elongated tube wherein the one or more circumferential surfaces are friction fit against the inner wall surface of the hollow tubular receiving portion of the elongated tube such that the axis of the mount is substantially aligned with or parallel to the axis of the hollow tubular receiving portion of the elongated tube; the mount including one or more legs each leg having a longitudinal axis, the one or more legs being rigidly interconnected to the radially extending members wherein the longitudinal axis of the hollow tubular receiving portion of the elongated tube is substantially aligned with or parallel to the axes of the one or more legs.

BRIEF DESCRIPTION OF THE DRAWINGS

The above and further advantages of the invention may be better understood by referring to the following description in conjunction with the accompanying drawings in which.

DETAILED DESCRIPTION

Figure 1:
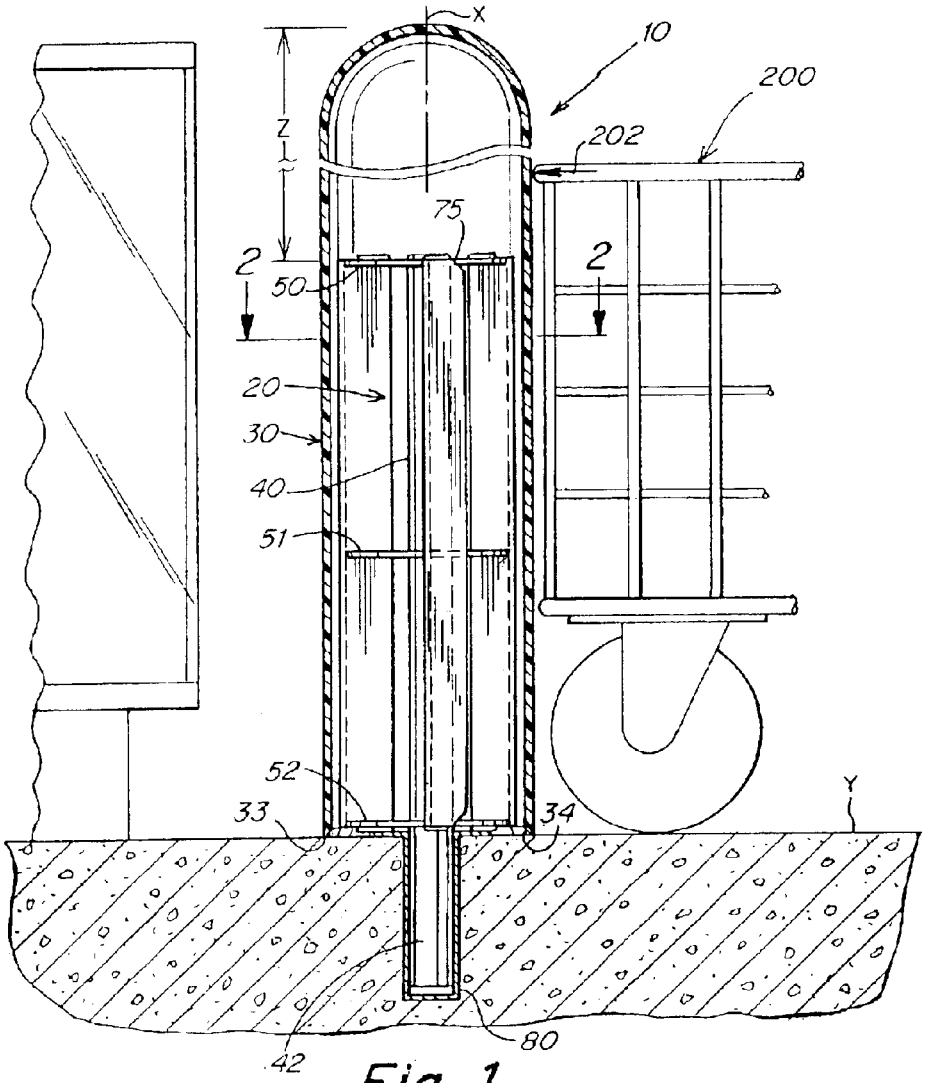
FIG. 1 is a side cross-sectional view of one embodiment of the invention having a stacked disc base arrangement having circumferentially projecting bendable flanges that frictionally engage the interior of a tubular bumper.
Figure 2:
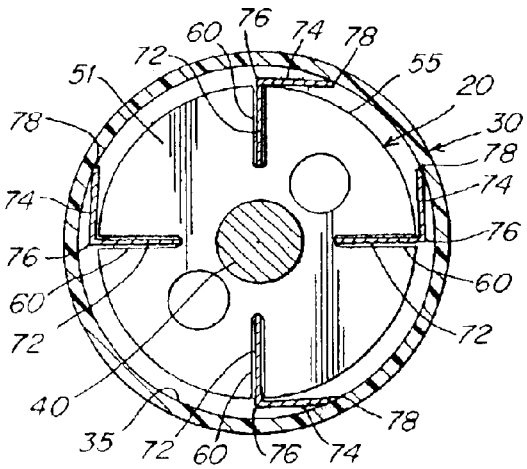
FIG. 2 is a cross-sectional top plan view taken along lines 2—2 of FIG. 1.

FIGS. 1–5 show an embodiment of a bumper assembly 10 according to the invention comprising a mounting base 20 that is frictionally fit within a lower open end of an outer tubular bumper 30 that is mounted upright along its axis X relative to a horizontal ground surface Y.

The mounting base assembly 20 in the embodiment of FIGS. 1–5 comprises a single central solid metal post 40 having three serially spaced apart discs 50, 51, 52 fixedly attached to the post 40. The discs 50 include radially disposed mounting apertures or slots 60 for receivably mounting a series of bendable struts 70 around the circumferential edges 55 of the mounting discs 50. In the FIGS. 1–5 embodiment, the discs 50 are shown in a disc configuration. The discs 50 can alternatively comprise more axially elongated tubular members.

As shown the lowermost attached disc 52 is attached at a selected point along the length of the post 40 so as to leave a bottom or distal end post portion 42 extending axially or longitudinally downwardly from the center of disc 52, the post portion 42 being readily insertable into a complementary receiving aperture 80 provided in the ground surface such that the entire assembly 10 can be mounted in an upright position as shown, for example, in FIG. 1. As shown, once mounted, the bumper 30 is firmly held in lateral position on the ground such that collision with a vehicle 200 or other object prevents the vehicle 200 or other object from travelling horizontally past the mounted bumper 30 on the ground or at least substantially redirecting the horizontal travel of the vehicle 200 away from any object that is on the opposite side of bumper 30 along the path of travel 202 of the vehicle 200 or other object.

Figure 3:
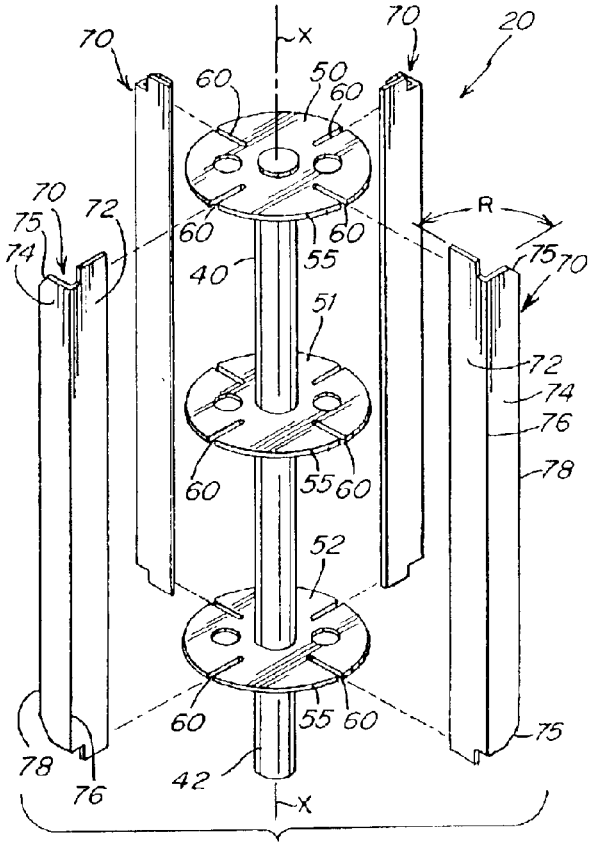
FIG. 3 is an exploded perspective view of the stacked disc base component of the FIG. 1 apparatus.
Figure 5:
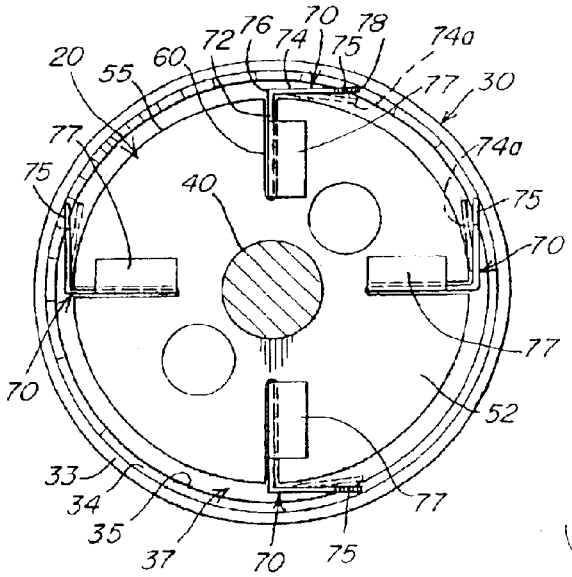
FIG. 5 is a cross sectional plan taken view along lines 5—5 of FIG. 4.
Figure 4:
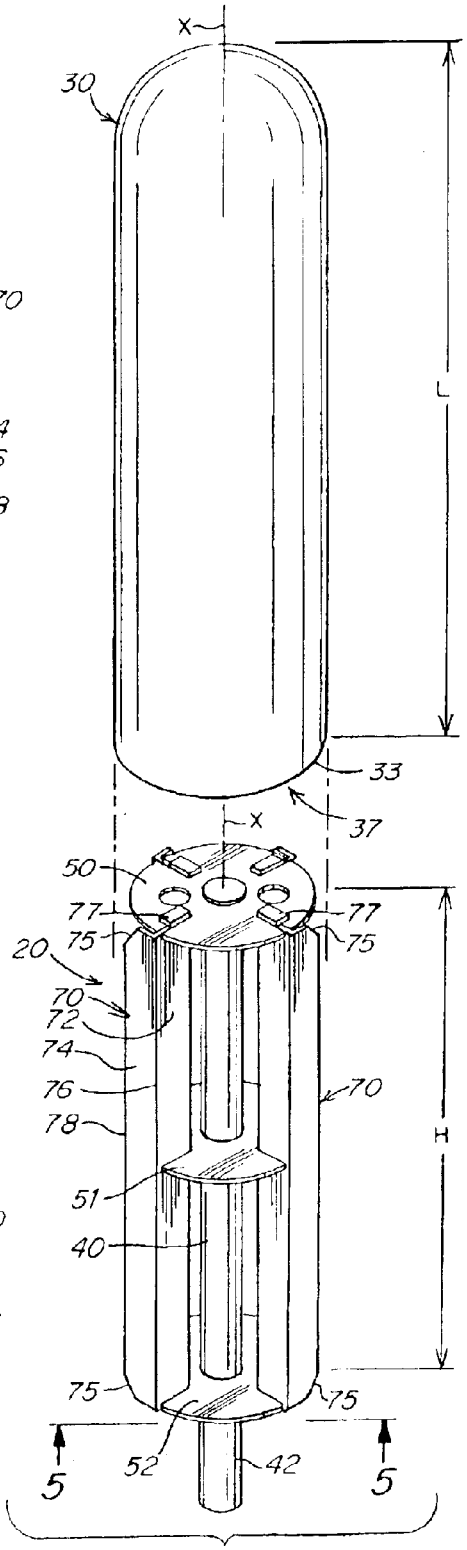
FIG. 4 is an exploded perspective view of the FIG. 1 apparatus showing the tubular bumper component axially separated from the base component.

As shown, the bendable, circumferentially or radially disposed struts 70 comprise elongated strips of two planar strips of rigid material 72, 74 fixedly/rigidly attached to each other at a selected angle R, FIG. 3, along a common longitudinal edge 76. The strips 72, 74 are typically comprised of a dimensionally stable, rigid material such as steel, aluminum, iron, plastic or the like having a selected thickness and rigidity such that the two strips are resiliently bendable relative to each other along edge 76. As shown in FIGS. 3, 4, 5 the strips 72 are slidable in a radial direction into slots 60 such that the struts 70 are mountable on the discs 50, 51, 52 in the assembled configuration shown in FIG. 4. The struts 70 are held in position in the longitudinal direction by flanges or tabs 77 attached to the upper edge of strips 74, the tabs 77 engaging the upper surface of uppermost disc 50 under force of gravity to hold the struts 70 in place against longitudinal or vertical movement relative to the discs 50, 51, 52. The lower edge of strips 74 can include a flange like tab similar to tabs 77 to engage the lower surface of disc 52 to prevent or limit upward longitudinal movement of struts 70.

In the FIGS. 3–5 embodiment shown, the angle R between rigid strips 72, 74 and the radial orientation of receiving slots 60 relative to the longitudinal axis X of the tube 30 or the post 40 are selected relative to each other so that the circumferentially disposed strips 74 can be bent to a sufficient degree upon engagement with wall surface 35 (thus decreasing angle R) such that when the mount assembly 20 is inserted within the open end 37 of tubular bumper 30, FIG. 4, there results a friction fit of the outer lateral edges 78 of the strips 74 against the interior wall surface 35 of the tubular bumper 30 by virtue of the strips 74 being bent relative to strips 72. The lower edge surface of tube 30 has a beveled surface 34 and the upper edges of strips 74 have beveled surfaces 75 to facilitate the frictional insertion of the base 20 into the tube end. The radially inwardly bent position of the circumferentially disposed strips 74 is shown in dashed lines 74*a* in FIG. 5, a stress being created in the edge 76 of the struts 70 that creates the friction fit of edges 78 against wall surface 35. As shown, the strips 72 are maintained in the substantially the same radial orientation as the slots 60 into which strips 72 are slid, the width of slots 60 being complementary to the width of strips 72. The radial orientation of strips 74 changes to 74*a* as a result of the force fitting of the edges 78 against wall surface 35. To facilitate insertion of the mount assembly 20 into the open end 37 of tube 30, the lower edge 33 of the tube 30 is beveled at 34, FIGS. 1,5, so as to engage bevels 75 on strips 74 and to bias the strips 74 inwardly to their stressed positions.

The length of the strips 74 are preferably selected such that the mount assembly 20 can be mounted within the open end of the bumper 30 where the entire length H, FIG. 4, of the mounting base assembly 20, FIG. 3, or at least the substantial majority of the longitudinal length H of the bendable friction fit strips 74 is engaged with wall surface 35 within the lower interior end portion of tubular bumper 30 as shown in FIG. 1. The lower longitudinal end of the strips 70 is preferably substantially coincident with the lower edge 33 of the tube 30 when the mount assembly is properly mounted within the hollow open end 37 of bumper 30. The mount assembly 20 is mounted within the hollow open end of bumper 30 at least to the extent necessary to leave a length of mounting rod portion 42 that extends at least about 4 inches below the bottom edge 33 of bumper 30 and preferably between about 6 and about 24 inches below.

The bumper 30 typically comprises a shock and/or crash resistant polymeric, plastic, rubber, or other relatively lightweight dimensionally stable material such as polypropylene, polyvinyl, polyester, polyethyl, polyaryl or similar material.

Other mechanisms analogous to the resiliently bendable struts 70 may be employed to effect a frictional engagement of the mount apparatus 20 with the inner wall 35 of the tube 30, the structural object of the mount assembly 20 being to frictionally mount the mount apparatus within the tubular bumper such that the downwardly projecting mounting leg or rod analogous to rod portion 42 is mounted in a substantially coaxial or parallel orientation with the axis of the hollow receiving end of the tubular bumper. For example the circumferential outer most edges 55 of discs 50, 51, 52 can include a layer of resiliently compressible material such as rubber or elastic that is compressed against wall surface 35 when the apparatus 20 is inserted within the open end 37 of the tube 30 thus frictionally holding the apparatus 20 in place once inserted, the diameter/radius of the discs being selected in advance to be complementary to the diameter/radius of the tubular aperture in the hollow end 37 of tube 30 such that the layer of compressible material will compressibly fit within aperture 37.

The height H of the portion of assembly 20 that is mounted within the receiving end of the bumper is typically between about 10% to about 50% of the overall longitudinal length L, FIG. 4, of the tubular bumper 30, preferably between about 15% and about 40% and most preferably less than about one-third or one quarter of the height L of the bumper 30. Conversely, the upper longitudinal length Z, FIG. 1, of the tubular bumper 30 which is not engaged with the mount 20 is between about 50% and about 90% of the overall length L of the tubular bumper 30. As shown, the distal end 42 of the post 40 extends longitudinally below the lowermost edge 33 of the bumper 30, typically between about 6 and about 24 inches, so that the post portion 42 can be readily inserted in the ground aperture 80 and the entire apparatus can be readily mounted in the upright position shown in FIG. 1.

The bumper 30 is shown in the Figures as straight. Alternatively, the bumper 30 or the axis of the bumper 30 may be curved or curvilinear along some portion of its overall length. Preferably, the lower hollow open receiving end portion of the bumper 30 has a straight axis for readily receiving a mounting apparatus such as mount 20 while the upper portion of the bumper may be curved or curvilinear along its axis. The lower open receiving end portion of the bumper is hollow for enabling ready receipt of a mounting apparatus. The upper portion of the bumper 30 that extends above the uppermost edge of the mount 20, i.e. the portion extending along length Z is preferably hollow but may also be solid.

Figure 6:
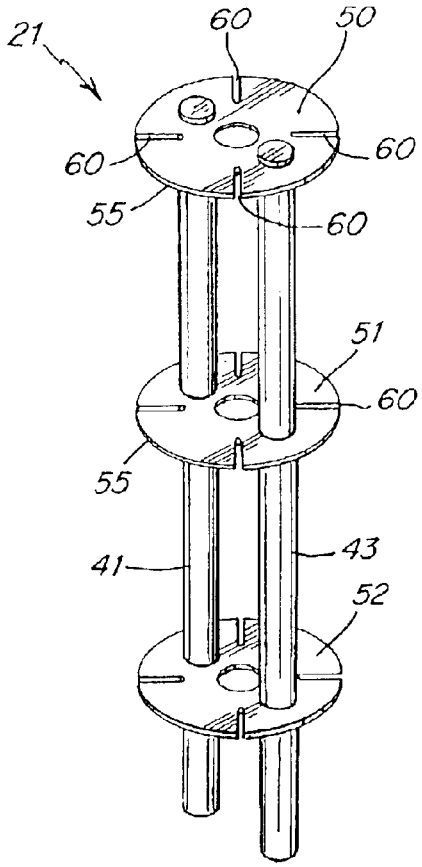
FIG. 6 is a perspective view of an alternative base component of an apparatus according to the invention showing the base component having two longitudinal mounting posts for a series of stacked discs.

FIG. 6 shows an alternative embodiment of the FIGS. 1–5 mount 20, where a mount 21 is provided having two non-coaxial mounting posts 41, 43 for insertion in two complementary apertures (not shown) in the ground for higher or better mounting stability of the apparatus. As shown, the mount 21 includes mounting discs 50, 51, 52 with receiving slots 60 for receiving struts analogous in structure, function, materials to those described above with reference to FIGS. 1–5.

Figure 7:
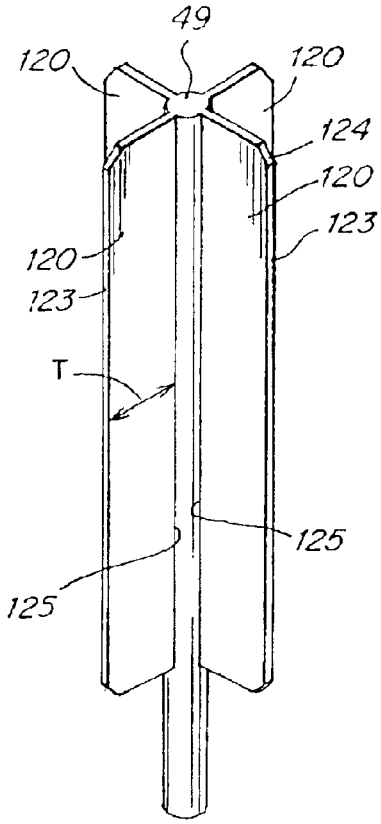
FIG. 7 is a perspective view of another alternative base component comprising a single central post having radially projecting fins that are bendable in a radial direction so as to friction fit against the interior surface of a tubular bumper.
Figure 8:
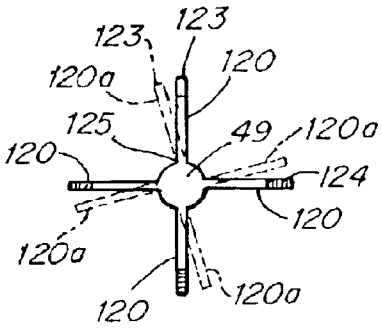
FIG. 8 is a top plan view of the base of FIG. 7.

FIG. 7 shows a mount embodiment comprising a single post 49, coaxial with the axis of the bumper, having radially projecting fins 120 rigidly but bendably attached along a radially inner edge 125 to the post 49 by conventional means such as welding, gluing or the like. The fins 120 have a width T selected to enable the outer radial surfaces 123 of the fins to extend into friction fit engagement with the inner surface 35 of the interior of the tubular member 30. As shown in FIG. 8, the fins 120 are resiliently bendable under stress into a position 120*a*, FIG. 8 whereby the end surfaces 123 of the fins frictionally engage the inner surface 35 of the tubular member 30 under the bending force around the weld/attachment line 125 or throughout the width of the fins 120. The fins 120 may also have bevels 124 similar to bevels 75 to aid insertion into tube 30.

Figure 9:
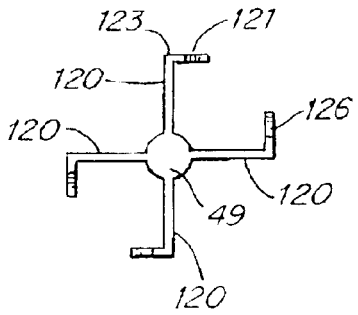
FIG. 9 is a top plan view of a base similar to the base shown in FIG. 7 where the fins have flange elements projecting from the outermost radial edge of the fins.

FIG. 9 shows an alternative configuration for the FIGS. 7, 8 embodiment where the fins 120 have flanged elements 121 attached to the radial or circumferential distal edges 123 of the fins 120, the flanged elements 121 providing greater frictional contact area with inner surface 35 of the tubular bumper 30. Flanged elements 121 may also be provided with bevels 126 to facilitate the frictional insertion.

Figure 10:
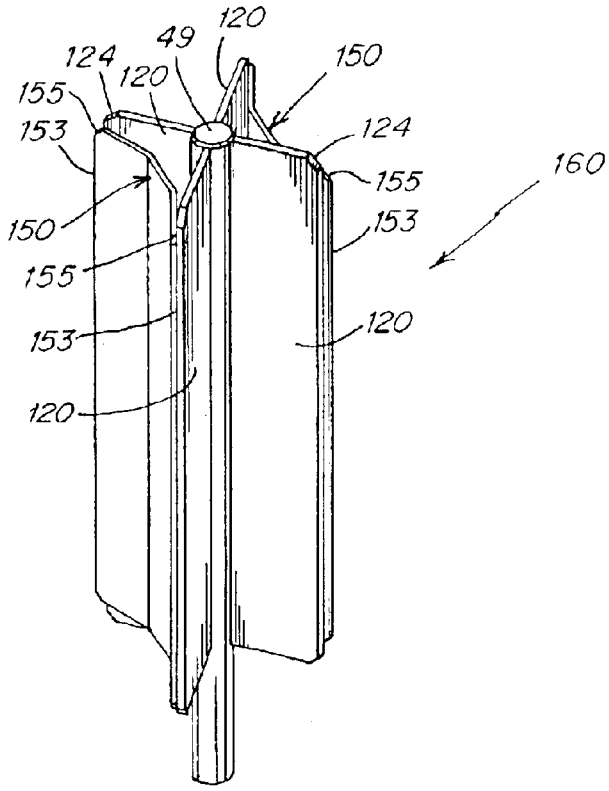
FIG. 10 is a perspective view of a base similar to the base of FIG. 7 having a spring component.
Figure 11:
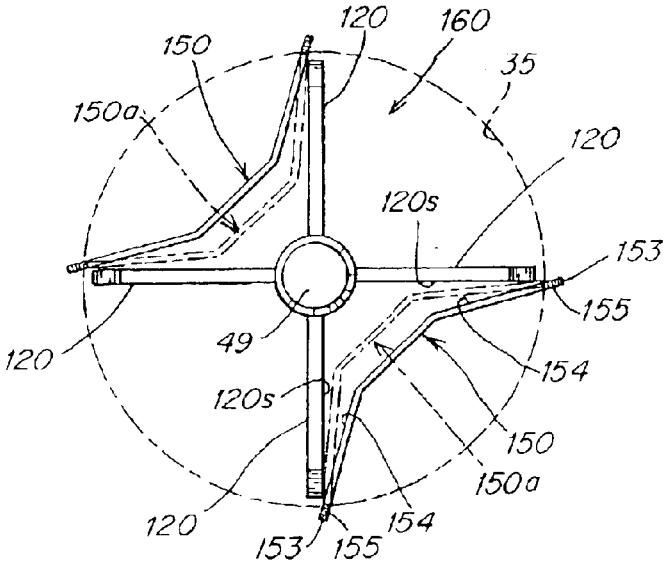
FIG. 11 is a top plan view of the base of FIG. 10.

FIGS. 10, 11 show an embodiment of a mounting mechanism 160 where a spring 150 is seated between adjacent fins 120 of a mount mechanism similar to the FIGS. 7, 8 mechanism. The spring 150 comprises a resiliently bendable elongated sheet 150 shown in its relaxed or unbent state in solid line form 150. As shown, in its relaxed, unbent state 150 in FIGS. 10, 11, the outer radial or circumferential edges 153 of the spring 150 protrude beyond the diameter of the inner wall surface 35 of the tube 30 when the rod 40 is mounted coaxially with the axis of the tube 30. When the apparatus 160 shown in FIGS. 10, 11 is inserted within the receiving hollow end of the tube 30, the outermost radial edges 153 engage the inner surface 35 of the tube 30 under tension and the spring 150 is bent radially inwardly toward the rod 40 to a tensioned or stressed position 150*a* as shown in FIG. 11. In the bent or tensioned position 150*a*, the radially distal surfaces 153 of the spring 150*a* frictionally engage the inner wall surface 35 and a complementary surface 154 of the spring 150 simultaneously frictionally engages an opposing surface 120*s* of the fins that faces the complementary opposing radially inward surface 154 of the spring 150*a*. The simultaneous frictional engagement of the spring 150*a* with both the inner wall surface 35 and the fins 120 firmly mounts the entire assembly 160 within the hollow receiving end of tube 30 and holds the tube 30 to the mounting mechanism 160 under frictional pressure. In the embodiment shown in FIGS. 10, 11 the spring 150 has a configuration adapted to seat between and be received between adjacent fins 120 such the adjacent fins 120 support and hold the spring 150 in the position shown in FIGS. 10, 11 when the spring is compressed or bent into the position shown as 150*a*. The spring 150 is typically comprised of a resiliently bendable sheet material such as steel, flexible polymer or plastic or the like. The spring is bendable to a sufficient to cause enough tension, stress or the like in the spring to create a friction engagement with both the inner wall 35 and the fins to hold the assembly 160 firmly in position and in firm engagement with both the tube wall and the fins 120. The spring may be beveled at 155 to aid insertion into tube 30.

In all of the embodiments shown, the mounting posts or legs of the mount apparatus have a longitudinal axis that is coaxial with or parallel to the axis X of the hollow tubular open end portion of the bumper 30. The mounting posts or legs are rigidly or fixedly interconnected to the radially extending member(s) or support the radially extending members in a position that enables a frictional, bendable or otherwise force fittable engagement between a circumferential edge or other wall engaging member of the radially extending members and the interior wall surface of the open end portion of the bumper 30.

The radially extending members have a circumferential member, such as struts 74, mounted on a circumferential edge of the members or have a circumferential surface, such as circumferential edges 123, 153 for frictionally engaging the interior wall surface of the bumper.

When a mount assembly according to the invention such as 20 or the FIGS. 7–9 or FIGS. 10–11 embodiments is inserted in the hollow open end of the tube, the mount is configured to be readily receivable within the configuration of the open end of the tube 30 and is force fittable within the open end readily without permanent attachment mechanisms such as screws, bolts, adhesives or interlocking mechanisms that otherwise would require an assembly process other than simple force fitting of the mount assembly within the open end.

What is claimed is:

1. Apparatus for mounting an elongated tube, the elongated tube extending from a receiving end to an opposing distal end, the receiving end comprising an open aperture and a hollow tubular receiving portion having a longitudinal axis and an inner wall surface radially disposed relative to the longitudinal axis, the apparatus comprising:

a mount having an axis, the mount comprising one or more radially extending members having circumferential surfaces or projections for mating with the inner wall surface of the hollow tubular receiving portion of the elongated tube under friction or pressure, the mount being receivable within the hollow tubular portion of the elongated tube wherein the one or more circumferential surfaces are friction fittable against the inner wall surface of the hollow tubular receiving portion of the elongated tube such that the axis of the mount is substantially aligned with or parallel to the axis of the hollow tubular receiving portion of the elongated tube;

the mount including one or more legs each leg having a longitudinal axis, the one or more legs being rigidly interconnected to the radially extending members wherein the longitudinal axis of the hollow tubular receiving portion of the elongated tube is substantially aligned with or substantially parallel to the axes of the one or more legs.

2. The apparatus of claim 1 wherein the mount is mountable within the hollow receiving portion of the elongated tube such that a distal end of the one or more legs extends longitudinally beyond the open distal end of the elongated tube.

3. The apparatus of claim 1 wherein the one or more radially extending members of the mount include a resiliently bendable or resiliently compressible mechanism that engages the interior wall surface of the hollow receiving portion of the elongated tube under friction on bending or compression of the resiliently bendable or compressible mechanism.

4. The apparatus of claim 2 wherein the distal end of the one or more legs has an outer circumferential surface that is receivable within one or more complementary apertures disposed within a ground surface for mounting the elongated tube in an upright orientation.

5. The apparatus of claim 1 wherein the elongated tube has a selected axial tube length, the mount being mounted within the hollow tubular portion along a length that extends from the open end of the hollow tubular portion that is less than about one third of the selected axial tube length.

6. Apparatus for mounting an upright elongated tube, the elongated tube extending from a receiving end to an opposing distal end, the receiving end comprising an open aperture and a hollow tubular receiving portion having an axis and an inner wall surface radially disposed relative to the axis, the apparatus comprising:

a mounting disc having an axis and one or more circumferential surfaces or projections for mating with the inner wall surface of the hollow tubular receiving portion of the elongated tube under friction or pressure, the mounting disc being received within the hollow tubular portion with the one or more circumferential surfaces being mated with the inner wall surface such that the axis of the disc is substantially aligned with or parallel to the axis of the hollow tubular receiving portion of the elongated tube;

one or more mounting struts each having a longitudinal axis, the one or more struts being rigidly interconnected to the disc wherein the longitudinal axis of the hollow tubular receiving portion of the elongated tube is substantially aligned with or parallel to the axes of the one or more struts and the struts extend beyond the open end when the disc is mounted within the hollow tubular portion.

7. The apparatus of claim 6 wherein the disc comprises a plurality of discs rigidly interconnected to each other, each disc having and an axis and being substantially coaxial.

8. The apparatus of claim 6 wherein the circumferential projections comprise one or more flanges extending radially outwardly from one or more selected locations around the circumference of one or more of the discs, the flanges being bendable under pressure to mate with the inner surface of the hollow tubular portion.

9. The apparatus of claim 6 wherein the one or more struts each have an outer circumferential surface that is receivable within one or more complementary apertures disposed within a ground surface for mounting the elongated tube in an upright orientation.

10. The apparatus of claim 6 wherein the elongated tube has an axial tube length wherein the disc is mounted within the hollow tubular portion extending from the open end along an axial length of the hollow tubular portion that is less than about one third of the axial tube length.

11. An upright tubular bumper comprising:

an elongated tube extending from a receiving end to an opposing distal end, the receiving end comprising an open aperture and a hollow tubular receiving portion having an axis and an inner wall surface radially disposed relative to the axis, a disc having an axis and one or more corresponding circumferential surfaces or projections for mating with the inner wall surface of the hollow tubular receiving portion of the elongated tube under friction or pressure, the disc being mounted within the hollow tubular portion with the one or more circumferential surfaces mated with the inner wall surface such that the axis of the disc is substantially aligned with or parallel to the axis of the hollow tubular receiving portion of the elongated tube;

one or more mounting struts each having a longitudinal axis, the one or more struts being rigidly interconnected to the disc wherein the longitudinal axis of the hollow tubular receiving portion of the elongated tube is substantially aligned with or parallel to the axes of the one or more struts and the struts extend beyond the open end when the disc is mounted within the hollow tubular portion.

12. The bumper of claim 11 wherein the disc comprises a plurality of discs rigidly interconnected to each other, each disc having and an axis and being substantially coaxial.

13. The bumper of claim 11 wherein the circumferential projections comprise one or more flanges extending radially outwardly from one or more selected locations around the circumference of one or more of the discs, the flanges being bendable under pressure to mate with the inner surface of the hollow tubular portion.

14. The bumper of claim 11 wherein the one or more struts each have an outer circumferential surface that is receivable within one or more complementary apertures disposed within a ground surface for mounting the elongated tube in an upright orientation.

15. The bumper of claim 11 wherein the elongated tube has an axial tube length, the disc being mounted within the hollow tubular portion extending from the open end along an axial length of the hollow tubular portion that is less than about one third of the axial tube length.

16. The bumper of claim 11 wherein the elongated tube comprises a high impact resistant polymeric material.

17. Apparatus for mounting an elongated tube, the elongated tube extending from a receiving end to an opposing distal end, the receiving end comprising an open aperture and a hollow tubular receiving portion having a longitudinal axis and an inner wall surface radially disposed relative to the longitudinal axis, the apparatus comprising:

a mount having an axis, the mount comprising one or more radially extending members having circumferential surfaces or projections for mating with the inner wall surface of the hollow tubular receiving portion of the elongated tube under friction or pressure, the mount being receivable within the hollow tubular portion of the elongated tube wherein the one or more circumferential surfaces are friction fittable against the inner wall surface of the hollow tubular receiving portion of the elongated tube such that the axis of the mount is substantially aligned with or parallel to the axis of the hollow tubular receiving portion of the elongated tube;

the mount including one or more legs each leg having a longitudinal axis, the one or more legs being rigidly interconnected to the radially extending members wherein the longitudinal axis of the hollow tubular receiving portion of the elongated tube is substantially aligned with or substantially parallel to the axes of the one or more legs.

18. The apparatus of claim 17 wherein the mount is mountable within the hollow receiving portion of the elongated tube such that a distal end of the one or more legs extends longitudinally beyond the open distal end of the elongated tube.

19. The apparatus of claim 17 wherein the one or more radially extending members of the mount include a resiliently bendable or resiliently compressible mechanism that engages the interior wall surface of the hollow receiving portion of the elongated tube under friction on bending or compression of the resiliently bendable or compressible mechanism.

20. The apparatus of claim 18 wherein the distal end of the one or more logs has an outer circumferential surface that is receivable within one or more complementary apertures disposed within a ground surface for mounting the elongated tube in an upright orientation.

21. The apparatus of claim 17 wherein the elongated tube has a selected axial tube length, the mount being mounted within the hollow tubular portion along a length that extends from the open end of the hollow tubular portion that is less than about one third of the selected axial tube length.

* * * * *